United States Patent [19]

Crepinsek

[11] Patent Number: 4,489,577

[45] Date of Patent: Dec. 25, 1984

[54] COUPLING OF KEYWAY ROSETTE TO LOCK BODY

[76] Inventor: Alois Crepinsek, 97 N. Arizona Pl., Chandler, Ariz. 85224

[21] Appl. No.: 448,686

[22] Filed: Dec. 10, 1982

[51] Int. Cl.[3] ..... E05B 15/02; E05B 9/08

[52] U.S. Cl. ..... 70/452; 70/370; 70/451; 403/348

[58] Field of Search ..... 70/451, 452, 449, 381, 70/370; 292/357, 350, 354, 355; 248/222.3; 403/348, 349

[56] References Cited

U.S. PATENT DOCUMENTS

| | | | |
|---|---|---|---|
| 213,252 | 3/1879 | Sargent | 70/451 |
| 549,134 | 11/1895 | Judd | 70/370 |
| 2,759,754 | 8/1956 | Kaiser | 70/451 X |
| 2,810,600 | 10/1957 | Kendrick | 292/357 |
| 3,677,593 | 7/1972 | Wahlberg | 292/357 X |
| 3,945,795 | 7/1973 | Sanders | 70/451 |

FOREIGN PATENT DOCUMENTS

| | | | |
|---|---|---|---|
| 521589 | 3/1931 | Fed. Rep. of Germany | 70/370 |
| 628361 | 3/1936 | Fed. Rep. of Germany | 70/452 |
| 2756542 | 6/1978 | Fed. Rep. of Germany | 70/451 |
| 995045 | 11/1951 | France | 70/370 |
| 12461 | of 1899 | United Kingdom | 292/354 |
| 593869 | 10/1947 | United Kingdom | 70/451 |

*Primary Examiner*—Robert L. Wolfe
*Assistant Examiner*—Russell W. Illich
*Attorney, Agent, or Firm*—James F. Duffy

[57] ABSTRACT

An improved lock mechanism whereby the raised element, or rosette, provided exteriorly for defining the keyway and providing secured access thereto is coupled to the lock body by mechanical means utilizing rigid interference fit lock mechanisms. Latch pins are emplaced within tapered latch recesses and the latch pins coupled one to another. A locking pin is driven into interference relationship with at least one of the latching pins to bar its movement within the latching recess and, thus, due to the fact that all latching pins are coupled one to another, an extremely strong coupling of the rosette to the lock body results.

5 Claims, 4 Drawing Figures

COUPLING OF KEYWAY ROSETTE TO LOCK BODY

BACKGROUND

1. Field of the Invention

The invention relates to locks such as dead-bolt locks which are mounted within a door.

The invention specifically relates to the manner in which the rosette which defines the keyway in a door lock and provides secure access thereto is coupled to the body of the door lock.

In particular, the invention provides the means for securing a rosette to a door lock cylinder without the use of external screw fasteners.

2. Prior Art

Door locks are generally provided with a central bore to accommodate the keyway and the locking mechanism. A conical flange, frequently referred to as a rosette, defines the keyway bore and provides secure access thereto. The rosette is frequently screw-threaded to the body of the lock or the lock cylinder. Means are then provided to make it difficult for an intruder to disengage the threaded coupling securing the rosette to the lock housing. To this end, a set screw is frequently driven in an interferring manner against the threaded couplings which engage the rosette to the lock body. Such attempts to secure the rosette to the lock body achieve marginal success at best. An intruder is frequently able to overcome the restraint applied to the threaded couplings and successfully remove the rosette and thus gain access to the inner workings of the lock.

It is therefore an objective of the invention to provide means for securing a rosette to a lock body by other than a threaded coupling.

It is a further object of the invention to provide a mechanical interference stop coupling for mounting a rosette to the body of a lock.

It is another object of the invention to provide a mechanical coupling of the rosette to a lock body in combination with mechanical means for locking the rosette into position and inhibiting the decoupling of the rosette from the lock body.

SUMMARY OF THE INVENTION

The invention represents an improvement in lock mechanisms. In a lock body which has a raised element means, hereinafter referred to as a rosette, for providing secure access to the keyway and lock mechanism within the lock body in which the rosette is coupled to the lock body by latch pins which are affixed to the rosette and inserted into slide latching recess means which are coupled to the lock body, the latch pins being lockingly engaged within the slide latching recess means upon proper movement of the rosette; the improvement disclosed herein prevents the disengagement of the latch pins from the slide latching recess means. The improvement comprises means for inhibiting disengagement of the first one of the latch pins from a first one of the slide latching recess means and further includes means, which couple a second one of the latch pins to said first one of the latch pins so as to inhibit rotation of the second latch pin about the first one and also for inhibiting disengagement of the second one of the latch pins from a second one of the slide latching recess means.

In the embodiment disclosed, the means for inhibiting the disengagement of a first one of the latch pins from a first one of the slide latching recess means comprises means for inhibiting translation of the said first one of the latch pins within the said first one of the slide latching recess means. The means for inhibiting translation of the said first one of said latch pins within the first one of the slide latching recess means comprises means coupled to the first one of the slide latching recess means for blocking the recess and thus inhibiting slide motion of the latch pin within that recess. The means for coupling a second one of the latch pins to the first one of the latch pins comprises an annular segment which is slidingly coupled to the lock body.

The improved lock may be further defined as comprising a lock body having therein a keyway and lock mechanism bore and a recessed annular segment diametrically displaced beyond a portion of the outer periphery of the keyway and lock mechanism bore. A first and second latch recess means is coupled to the lock body, one of each intercepting the extremes of the noted recessed annular segment. A raised element means, or rosette, further defines the keyway and lock mechanism bore and provides secure access thereto. First and second latch pins are coupled to the rosette and the first latch pin is lockingly engaged in the first slide latching recess means while the second latch pin is lockingly engaged in the second slide latching recess means. An annular segment is slidingly coupled to the recessed annular segment in the lock body and is employed for coupling the first latch pin to the second latch pin so as to inhibit rotation of the second latch pin about the first. Latch pin locking means for inhibiting the disengagement of the first latch pin from the first slide latching recess means are provided and, in cooperation with the said annular segment, inhibit the disengagement of the second latch pin from the second slide latching recess means.

DESCRIPTION OF THE INVENTION

Figure 1:
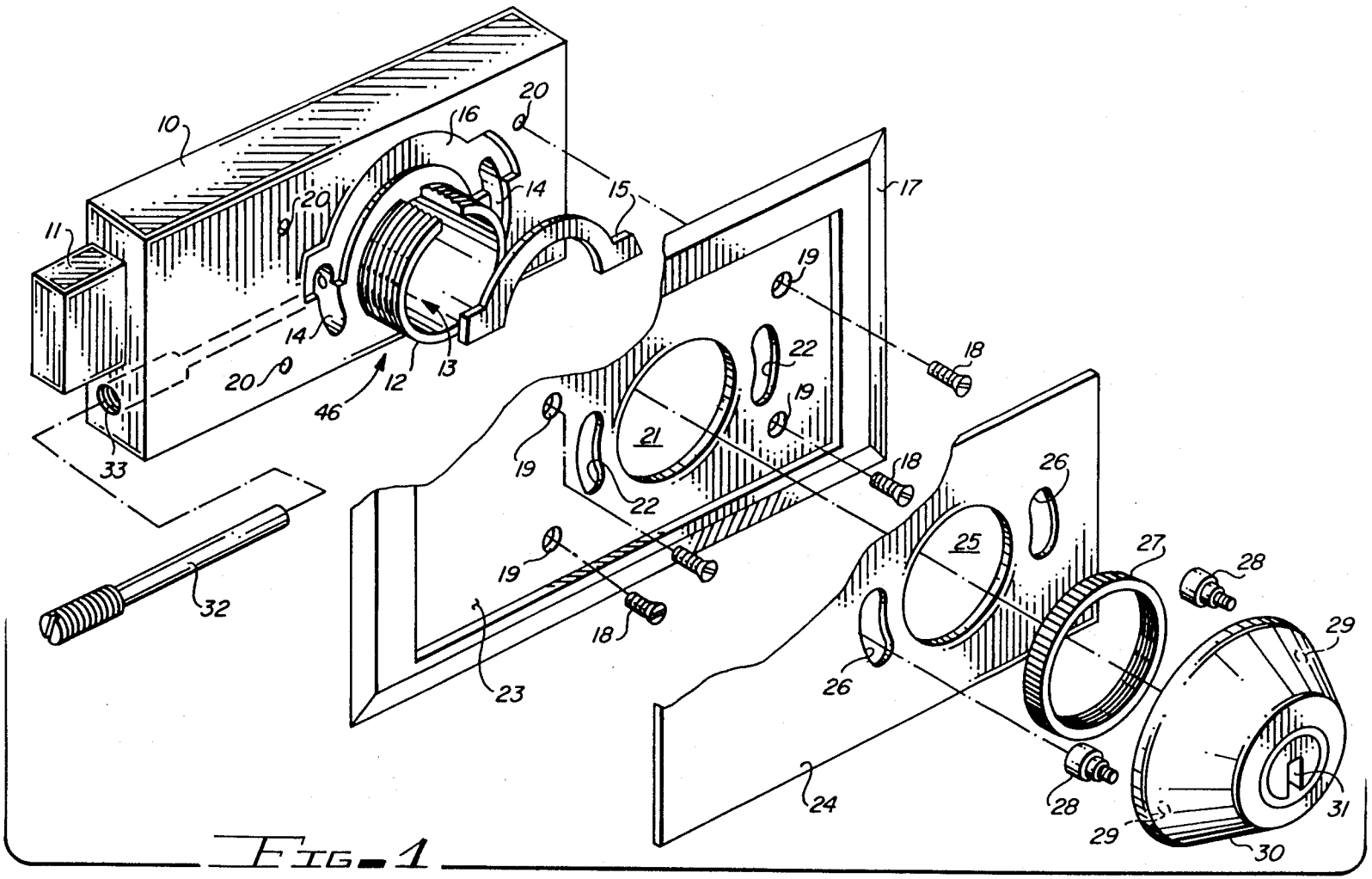
FIG. 1, in perspective, is an exploded assembly of the lock body and the elements wherein the rosette is secured using positive mechanical stop, interference lock, coupling means.

For the purposes of promoting an understanding of the principles of the invention, reference will now be made to the embodiments illustrated in the drawings and specific language will be used to describe the same. It will, nevertheless, be understood that no limitation of the scope of the invention is thereby intended, such alterations and further modifications in the illustrated device; and such further applications of the principles of the invention as illustrated therein being contemplated as would normally occur to one skilled in the art to which the invention relates.

An exploded assembly drawing is presented in FIG. 1. Here a lock body 10 provides a dead-bolt 11 locking bar for use with a door and door jamb arrangement, not shown. A threaded cylinder 12 is coupled to the lock body 10 and provides therein a bore 13 to provide access for a keyway and the lock mechanism. Threaded cylinder 12 will provide the means, in combination with retainer nut 27, for securely coupling door protection plate 17 and cover plate 24 to the door and to lock body 10.

Within lock body 10 are two slide latch clearance recesses 14 which will accept in a noninterfering manner latch pins 28 which are threadedly coupled to threaded holes 29 within the raised element, or rosette, 30 which carries keyway 31 and provides secure access thereto.

A recess 16, comprising an annular segment, accommodates slide coupler 15, a segment of similar annular configuration to that of recess 16, which is slidingly coupled to lock body 10 within recess 16. Slide coupler 15 will be employed to couple latch pins 28, one to the other, when the latch pins 28 are inserted within slide latch clearance recesses 14 of lock body 10.

With lock body 10 mounted in a door in the usual manner well known to those skilled in the art, door protection plate 17 is coupled to lock body 10 by passing the clearance hole 21 of plate 17 over threaded cylinder 12. At this time, clearance holes 19 in plate 17 will be aligned with tapped holes 20 in lock body 10. Screw fasteners 18 are passed through clearance holes 19 and threadedly engaged within tapped holes 20 so as to securely affix door protection plate 17 to lock body 10.

When this is done, slide latch recesses 22 in plate 17 will be aligned with slide latch clearance recesses 14 in lock body 10. Slide latch recesses 22 are tapered such that when latch pins 28, coupled to rosette 30, are inserted within slide latch recesses 22 and the rosette 30 rotated, a locking engagement results of latch pins 28 with slide latching recess 22.

Door protection plate 17 is provided with a recess 23 which accepts cover plate 24, threaded cylinder 12 being passed through clearance hole 25 in the course of the assembly. Retainer ring 27 is then threadedly coupled to threaded cylinder 12 so as to securely affix cover plate 24 into position within the recess 23 of door protection plate 17. Cover plate 24 thus securely covers screw fasteners 18 and adds to the decorative finish of the assembly of door protection plate 17 with the door and lock body 10. With cover plate 24 so positioned, an additional pair of slide latch recesses 26 is emplaced in alignment with slide latching recesses 22 of cover plate 17. As with slide latching recesses 22, recesses 26 are also tapered to provide for locking engagement with latch pins 28.

In a manner to be more fully disclosed hereinafter, rosette 30, with latch pins 28 coupled thereto, is affixed to the assembly by inserting latch pins 28 through latch recesses 26 and 22 and into clearance recesses 14 and rotating the rosette 30 so as to bring latch pins 28 into locking engagement within the tapered recesses 22 and 26. A locking pin 32 is then threadedly engaged within locking pin receiver 33 of lock body 10 so as to provide a locking interference with one of latch pins 28 so as to prevent its disengagement from within the locking recesses 22 and 26. This will be disclosed in greater detail in the discussion of FIGS. 2–4.

Figure 2:
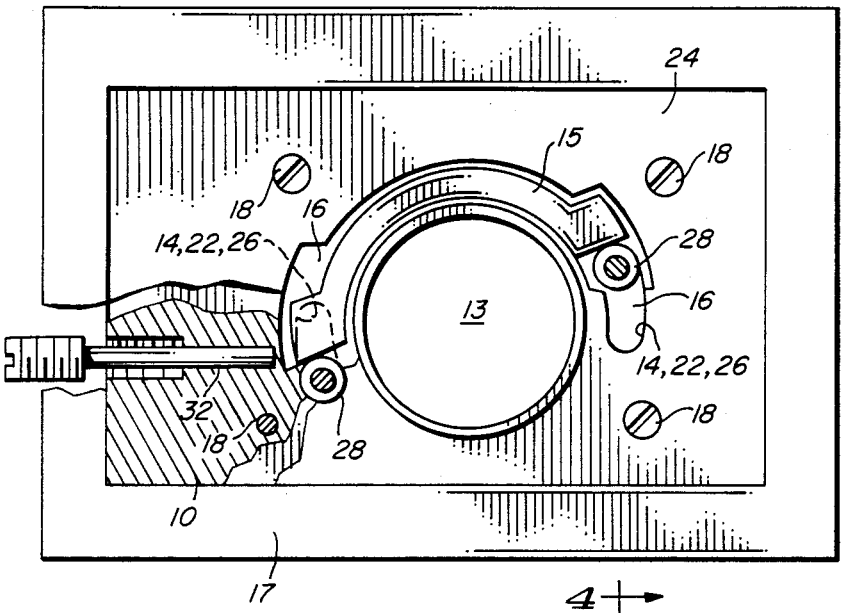
FIG. 2 illustrates the manner in which the latch pins of the rosette are coupled together when first emplaced within the slide latching recess means of the lock.
Figure 3:
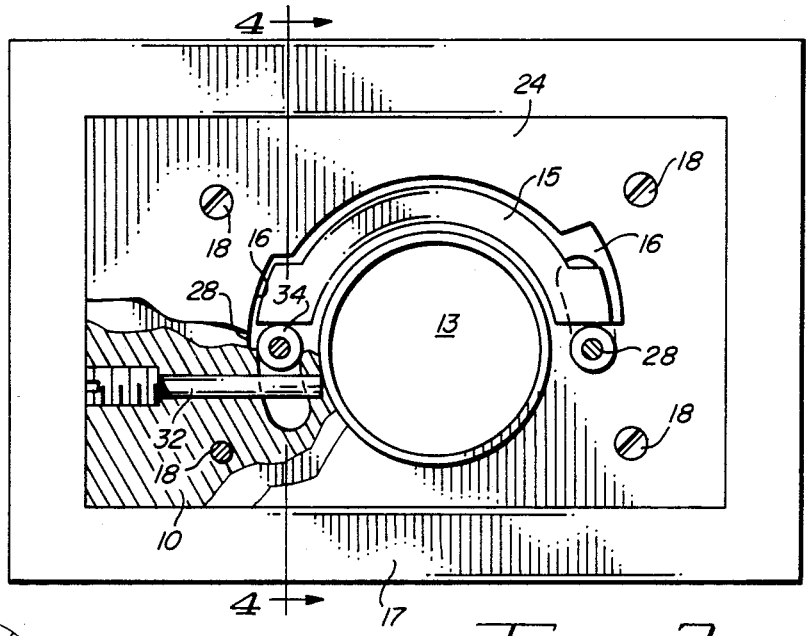
FIG. 3 illustrates the position of the latch pins after the rosette has been rotated sufficiently to lockingly engage the latch pins within the latching recesses and further illustrates the emplacement of the locking pin which provides an interference lock for inhibiting the disengagement of the latch pins from the latching recesses.

The drawings of FIGS. 2 and 3 have been reduced to the minimal detail to enable an understanding of the invention and thus the rosette to which latch pins 28 are attached is not illustrated. In FIG. 2, the latch pins 28, coupled to rosette 30 not shown, have been inserted within latching recesses 22 and 26 and extend into the clearance recess 14 of of the lock body 10. Slide coupler 15, emplaced within slide recess 16 of lock body 10, makes coupling contact with each of latch pins 28. In the illustration of FIG. 2, latch pins 28 are not in locking engagement with recesses 22 and 26.

In FIG. 3, latch pins 28 have been drawn into locking engagement with recesses 22 and 26 by rotating the rosette 30, not shown, in a clockwise manner so as to cause each of latch pins 28 to be brought into locking engagement with the tapered ends of recesses 22 and 26. As is noted in FIG. 3, slide coupler 15, still couplingly engaged with each of latch pins 28, has slid along the arc of slide coupler recess 16 in response to the movement of latch pins 28 into locking engagement with the tapered ends of recesses 22 and 26.

Locking pin 32, shown drawn to the left in FIG. 2, is threadedly coupled into the body 10 of the lock so as to be drawn toward the right entering the left-hand clearance recess 14 of lock body 10 in a manner so as to interfere with the disangagement of the left-hand latch pin 28 from the left-hand tapered recesses 22 and 26.

Under the conditions shown in FIG. 3, if an attempt is made to rotate rosette 30, not shown, in a counterclockwise direction so as to draw latch pins 28 out of locking engagement with tapered recesses 22 and 26, locking pin 32 will prevent the disengaging movement of the left-hand latch pin from its tapered recesses 22 and 26 while slide coupler 15, which couples latch pins 28 one to the other, prevents the right-hand latch pin 28 from rotating about the left-hand latch pin 28 and thus being slidingly disengaged from its tapered latching recesses 22 and 26.

Figure 4:
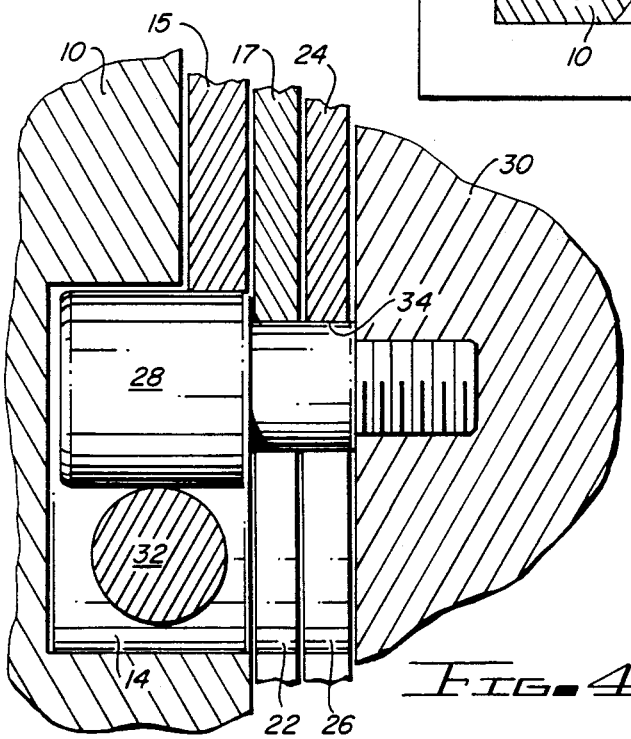
FIG. 4 is a cross-sectional view taken along lines 4—4 of FIG. 3 illustrating the mechanical engagement of the latching pins within the latching recesses and the interference locking of the assembly.

The interfering locking relationship of the parts is shown in the cross-sectional view taken across line 4—4 of FIG. 3 and shown in FIG. 4. Here, the left-hand latch pin 28 is threadedly engaged within the rosette 30. The left-hand latch pin 28 has been passed through tapered recesses 26 and 22 of cover plate 24 and door protection plate 17, respectively. Rosette 30 has then been rotated in a clockwise direction which raises latch pin 28 from the lower regions of recesses 26 and 22 to the upper, tapered regions where a locking engagement between of the recesses 26 and 22 and latch pin 28 occurs. Slide coupler 15, in contact with the left-hand latch pin 28, accomplishes a rigid mechanical coupling between the left-hand latch pin 28 and the right-hand latch pin 28. The locking engagement of latch pin 28 with the walls of recesses 22 and 26 and with plates 17 and 24 is shown at reference 34 of FIG. 4. When lock pin 32 is driven into clearance recess 14 within lock body 10, it engages in an interfering relationship with latch pin 28 preventing latch pin 28 from being lowered, by counterclockwise rotation of rosette 30, so as to eliminate the interference 34 and permit the subsequent removal of latch pin 28 from recesses 22 and 26. Since locking pin 32 may only be withdrawn from interfering relationship with the left-hand latch pin 28 when the door in which lock body 10 is mounted has been emplaced in an open position, the coupling of rosette 30 to lock body 10 has been achieved in a highly secure manner. Unlike earlier locks which rely on a locking pin driven into interference with the threads of a screw fastened rosette, the present invention offers highly improved, anti-intrusion characteristics to the lock body on which it is provided as an improvement.

What has been disclosed is an improved lock mechanism whereby the raised element, or rosette, provided exteriorly for defining the keyway and providing secured access thereto is coupled to the lock body by mechanical means utilizing rigid interference fit lock mechanisms. Latch pins are emplaced within tapered latch recesses and the latch pins coupled one to another. A locking pin is driven into interference relationship with at least one of the latching pins to bar its movement within the latching recess and, thus, due to the fact that all latching pins are coupled one to another, an extremely strong coupling of the rosette to the lock body results.

Those skilled in the art will conceive of other embodiments of the invention which may be drawn from the teachings herein. To the extent that such other embodiments are so drawn, it is intended that they shall fall within the ambit of protection of the claims appended hereto.

Having described my invention in the foregoing specification and the accompanying drawings in such a clear and concise manner that those skilled in the art will easily understand and readily practice the invention, that which I claim is:

1. In a lock body having a raised element means for providing secure access to the keyway and lock mechanism within the lock body, said raised element means being coupled to said lock body by latch pins affixed to said raised element means and inserted into slide latching recess means coupled to said lock body said latch pins being lockingly engaged within said slide latching recess means upon preselected movement of said raised element means, the improvement for preventing the disengagement of said latch pins from said slide latching recess means comprising:

means for inhibiting disengagement of a first one of said latch pins from a first one of said slide latching recess means said disengagement inhibiting means further comprising means for inhibiting translation of said first one of said latch pins within said first one of said slide latching recess means; and means, coupling a second one of said latch pins to said first one of said latch pins for inhibiting rotation of said second one about said first one of said latch pins for inhibiting disengagement of said second one of said latch pins from a second one of said slide latching recess means wherein said means coupling a second one of said latch pins to said first one of said latch pins comprises an annular segment further slidingly coupled to said lock body.

2. The improvement of claim 1 wherein said means for inhibiting translation of said first one of said latch pins within said first one of said slide latching recess means comprises means coupled to said first one of said slide latching recess means for blocking the recess of said slide latching recess means and inhibiting slidè motion of said latch pin therein.

3. An improved lock comprising:

a lock body having therein a keyway and lock mechanism bore and a recessed annular segment diametrically displaced beyond a portion of the outer periphery of keyway and lock mechanism bore;

first and second slide latch recess means coupled to said lock body, one of each intercepting the extremes of said recessed annular segment;

raised element means for further defining said keyway and lock mechanism bore and providing secure access thereto;

first and second latch pins coupled to said raised element means said first latch pin being further lockingly engaged in said first slide latch recess means and said second latch pin being further lockingly engaged in said second slide latch recess means;

an annular segment slidingly coupled to said recessed annular segment in said lock body for coupling said first latch pin to said second latch pin for inhibiting rotation of said second latch pin about said first latch pin; and latch pin locking means for inhibiting the disengagement of said first latch pin from said first slide latch recess means and, in cooperation with said annular segment, for inhibiting the disengagement of said second latch pin from said second slide latch recess means.

4. In a lock body having a raised element means for providing secure access to the keyway and lock mechanism within the lock body, said raised element means being coupled to said lock body by a pair of diametrically opposed latch pins affixed to said raised element means and inserted along axes transverse to the longitudinal axis of said lock body into slide latching recess means within said lock body said latch pins being lockingly engaged within and disengaged from said slide latching recess means by rotation of said raised element means about its longitudinal axis, the improvement for preventing the disengagment of either of said latch pins from either said slide latching recess means comprising slide coupling means comprising an independent annular segment slidingly coupled to said lock body for coupling a first one of said pair of latch pins to the second one of said pair; and disengagement inhibiting means retractingly coupled to said first one of said pair or latch pins for inhibiting disengaement of said first latch pin from a first one of said slide latching recess means.

5. The improvement of claim 4 wherein said disengagment inhibiting means further comprises a screwthread adjustable pin coupled to said lock body for retractable insertion within said first one of said slide latching recess means.

* * * * *